US007474173B2

(12) United States Patent
Avramis et al.

(10) Patent No.: US 7,474,173 B2
(45) Date of Patent: Jan. 6, 2009

(54) CROSS-POLAR AND CO-POLAR TRANSCEIVER

(75) Inventors: Evangelos Avramis, Straelen (DE); Peter Hopkinson, Davenport (GB); David John Roulston, Mossley (GB); Ronald P. A. Schiltmans, Toenisvorst (DE)

(73) Assignee: ASC Signal Corporation, Garner, NC (US)

( * ) Notice: Subject to any disclaimer, the term of this patent is extended or adjusted under 35 U.S.C. 154(b) by 261 days.

(21) Appl. No.: 11/426,673

(22) Filed: Jun. 27, 2006

(65) Prior Publication Data

US 2007/0296518 A1 Dec. 27, 2007

(51) Int. Cl.
*H01P 5/12* (2006.01)
*H01P 1/161* (2006.01)

(52) U.S. Cl. ..... 333/126; 333/129; 333/135; 333/21 A; 333/21 R

(58) Field of Classification Search ..... 333/126, 333/129, 135, 21 A, 21 R
See application file for complete search history.

(56) References Cited

U.S. PATENT DOCUMENTS 5,162,808 A * 11/1992 Kim ..... 343/786
6,009,304 A 12/1999 Kato
6,373,445 B1 4/2002 Kuno
6,424,817 B1 7/2002 Hadden et al.
6,507,952 B1 1/2003 Miller et al.
6,560,850 B2 * 5/2003 St. John et al. ..... 29/600
6,600,897 B1 7/2003 Watanabe et al.
6,640,084 B2 * 10/2003 Pande et al. ..... 455/3.01
6,677,911 B2 * 1/2004 Moheb ..... 343/786
2004/0029549 A1 2/2004 Fikart
2004/0077307 A1 4/2004 Atarashi

FOREIGN PATENT DOCUMENTS

JP P2000252741 9/2000
WO WO2005109703 11/2005
WO WO2006040538 6/2006

* cited by examiner

*Primary Examiner*—Robert Pascal
*Assistant Examiner*—Kimberly E Glenn
(74) *Attorney, Agent, or Firm*—Babcock IP, PLLC

(57) ABSTRACT

A transceiver allowing transmission of a co-polar transmit signal and simultaneous reception of co-polar receive and cross-polar receive signals. An integrated orthogonal mode transducer and diplexer module containing a plurality of filters between a feed port, co-polar transmission port, co-polar reception port and cross-polar reception port is mounted within the transceiver housing with the feed port aligned with or forming the feed flange of the transceiver. A transmitter printed circuit board is aligned with the transmission waveguide port and a receiver printed circuit board is aligned with the co-polar reception and cross-polar reception ports of the integrated orthomode transducer and diplexer module.

20 Claims, 5 Drawing Sheets

CROSS-POLAR AND CO-POLAR TRANSCEIVER

BACKGROUND

Satellite communication systems are known and generally well understood. Integrated transceivers proximate the boom arm of a satellite dish directly link the antenna feed to signal separation, reception and transmission components and electrical circuitry housed within a common enclosure, greatly simplifying component interconnections and environmental sealing requirements.

Satellite communications radio frequency signals may be received and or transmitted via cross-polar or co-polar signals. Filtering required to separate these signals from one another has previously required numerous separate filter components resulting in an assembly that is unacceptably large and or has degraded electrical performance. Previous systems have used an integrated transceiver or separate transmit electronics, receive electronics and an orthomode transducer (OMT) or diplexer to receive co-polar or cross-polar signals with respect to the transmission signal.

The increasing competition for integrated satellite transceivers adapted for high volume consumer applications has focused attention on improving electrical performance as well as cost reductions resulting from reduced materials and manufacturing cost as well as service and installation efficiencies.

Therefore, it is an object of the invention to provide an apparatus that overcomes deficiencies in the prior art.

BRIEF DESCRIPTION OF THE DRAWINGS

The accompanying drawings, which are incorporated in and constitute a part of this specification, illustrate embodiments of the invention and, together with the general and detailed descriptions of the invention appearing herein, serve to explain the principles of the invention.

DETAILED DESCRIPTION

A transceiver with a cross-polar, co-polar receiver according to the invention is integrated into a single enclosure 10. An OMT and diplexer module 12 may be mounted within the transceiver enclosure 10 without requiring specialized alignment procedures in multiple planes.

Figure 1:
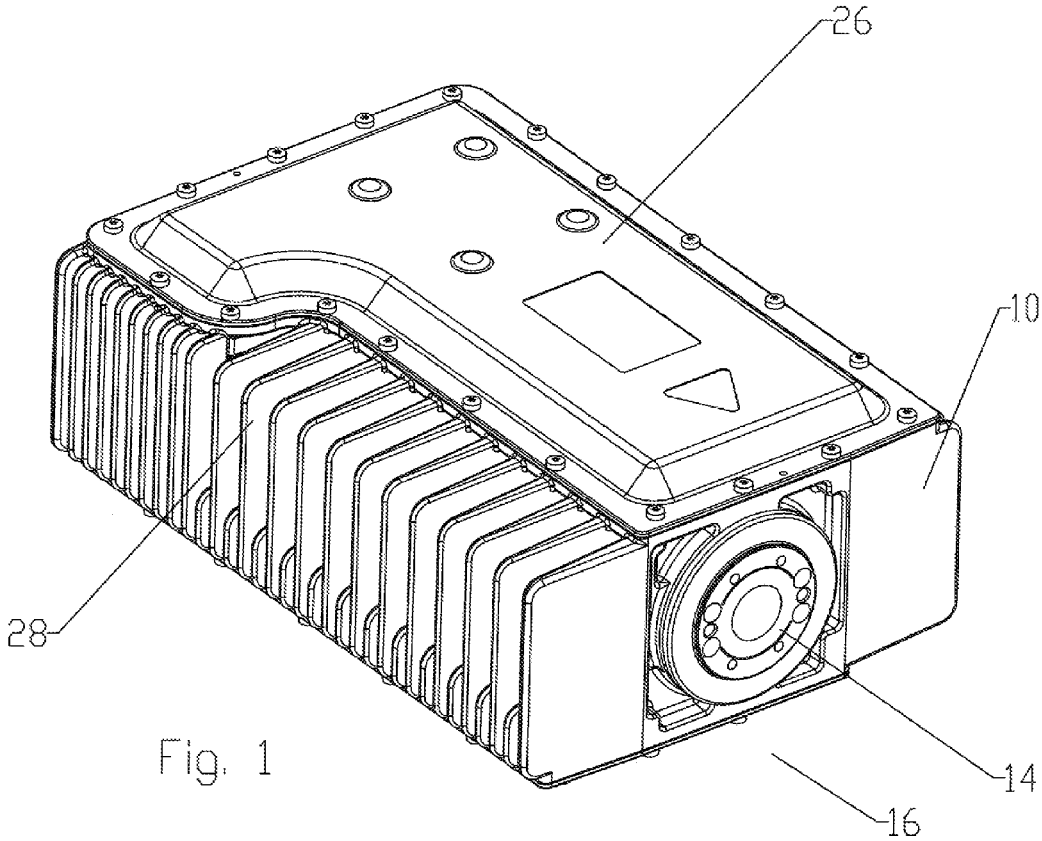
FIG. 1 is an isometric front side view of an exemplary embodiment of the invention.
Figure 2:
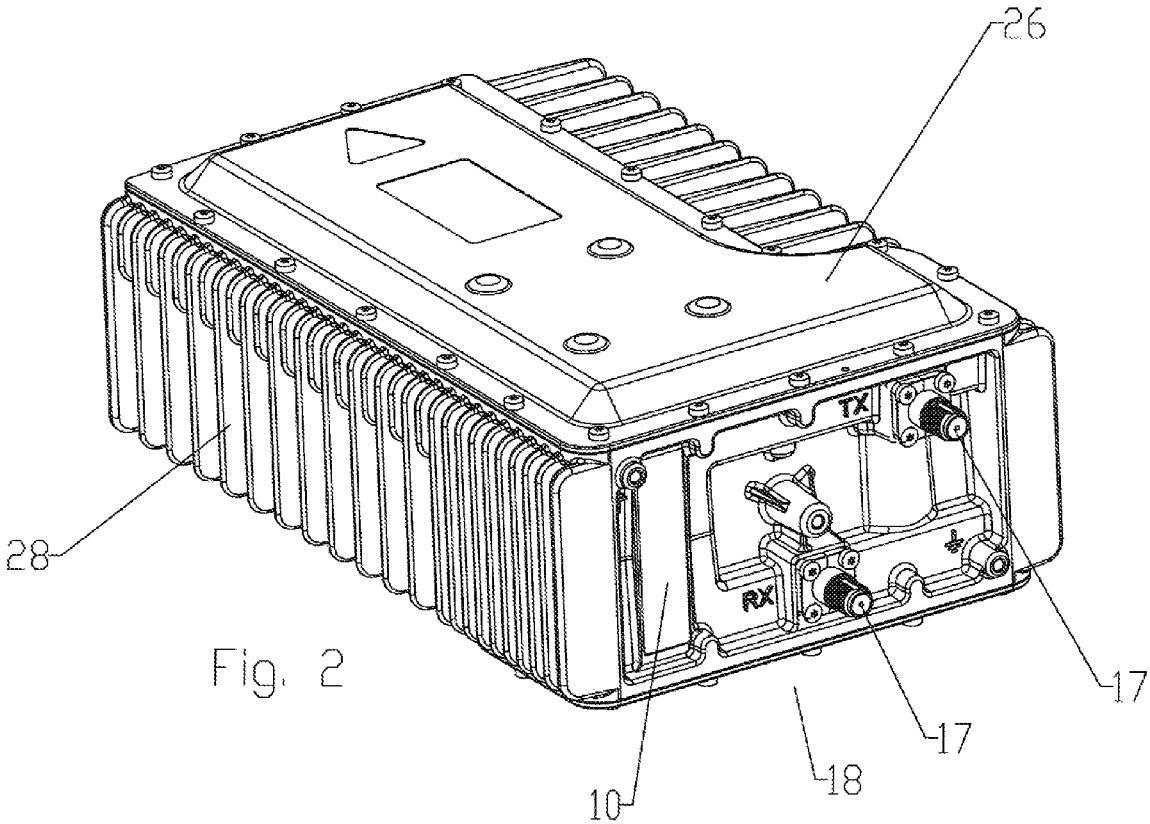
FIG. 2 is an isometric end view of an exemplary embodiment of the invention.
Figure 3:
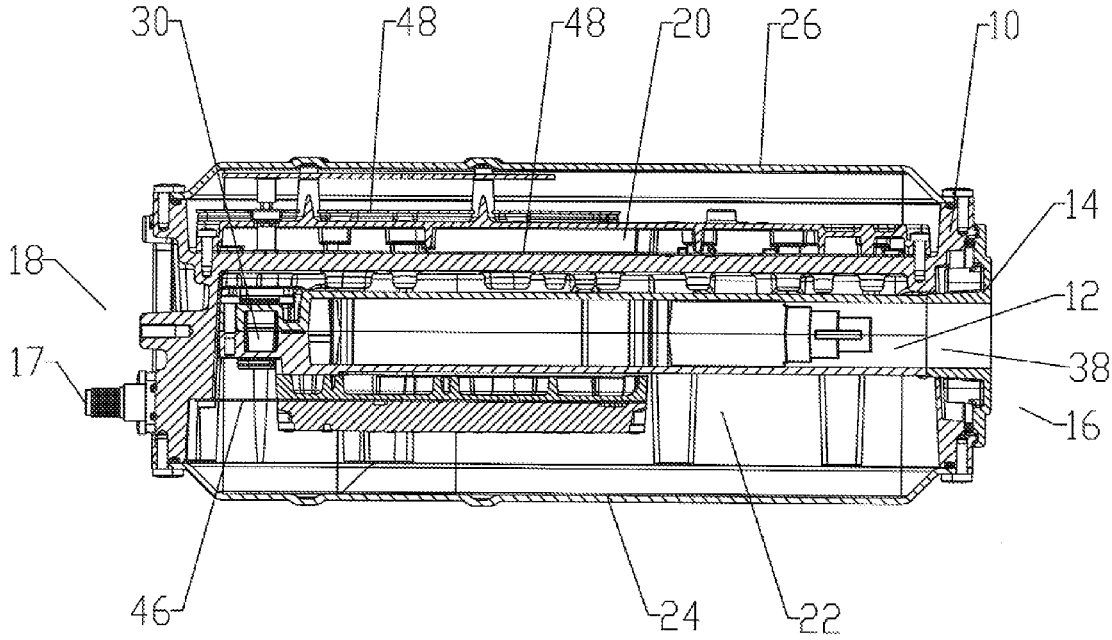
FIG. 3 is a cut-away side view of FIG. 1.

As shown in FIGS. 1-3 an enclosure 10 according to an exemplary embodiment of the invention has a feed flange 14 connection on a front end 16 and signal connection(s) 17 at the back end 18. The enclosure has a top side transmitter cavity 20 and a bottom side receiver cavity 22. A receiver cavity cover 24 and a transmitter cavity cover 26 enclose and environmentally seal the receiver cavity 22 and the transmitter cavity 20, respectively. Heat sink(s) 28 may be arranged along the exterior sides of the enclosure 10 to assist with dissipation of heat generated by transceiver operation.

Figure 4:
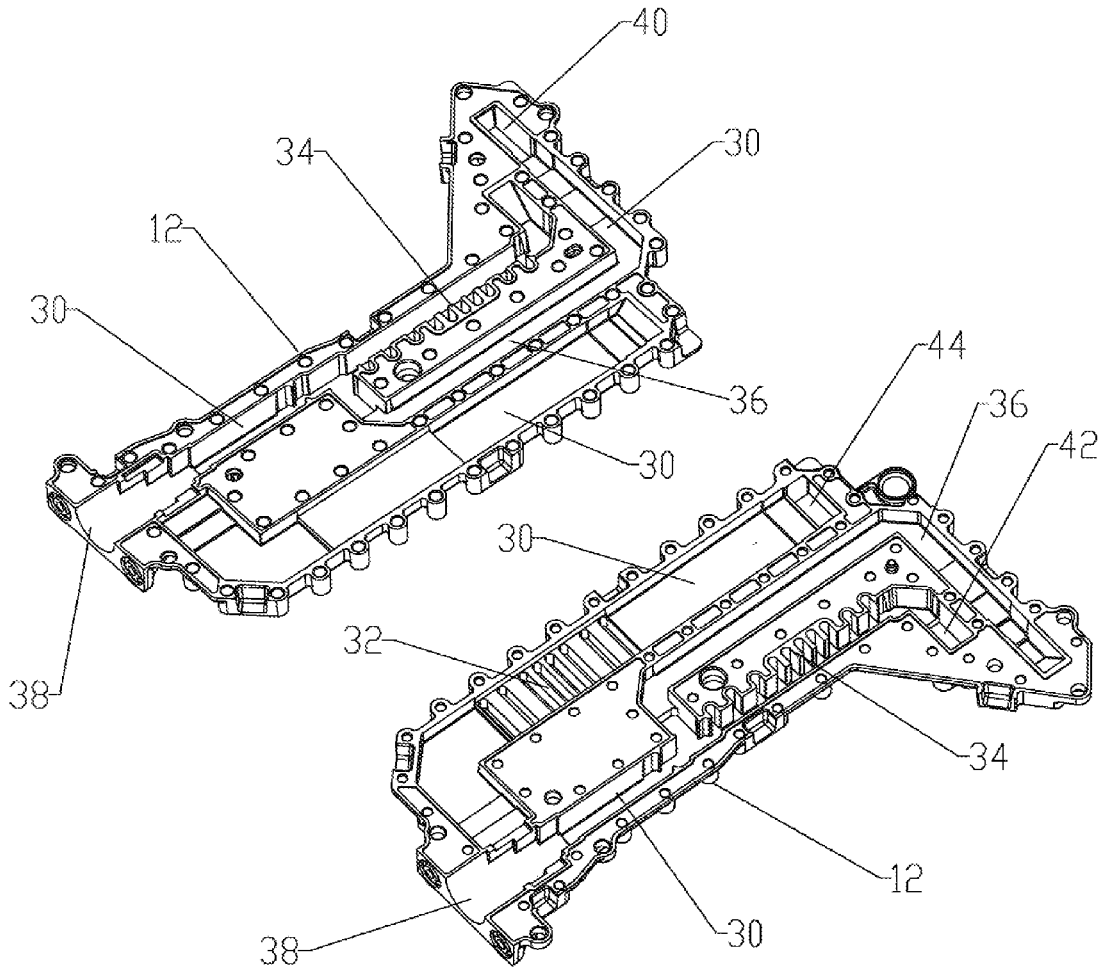
FIG. 4 is an isometric view of a two portion OMT and diplexer module according to the invention, showing the interior surfaces of the two portions.

The OMT and diplexer module 12, as best shown in FIG. 4, may be formed as a two piece assembly with grooves and sealing surfaces that cooperate to form a waveguide 30 and filter network functioning as an OMT and diplexer with cross-polar transmit reject filter (X-TRF) 32, co-polar transmit reject filter (C-TRF) 34, and co-polar receive reject filter (C-RRF) 36. Signals are routed along a range of different waveguide 30 paths between a feed port 38, co-polar transmission port 40, co-polar reception port 42 and cross-polar reception port 44. Arrayed along the different paths, the X-TRF 32, C-TRF 34 and C-RRF 36 filters are formed in the waveguide 30 sidewalls and or by application of a selected waveguide 30 cross section dimension relative to other waveguide 30 paths to remove undesired radio frequency signal components. Design and dimensional specifics of waveguide band-pass, high-pass and notch filters are well known in the art and as such are not discussed herein with greater detail.

Figure 5:
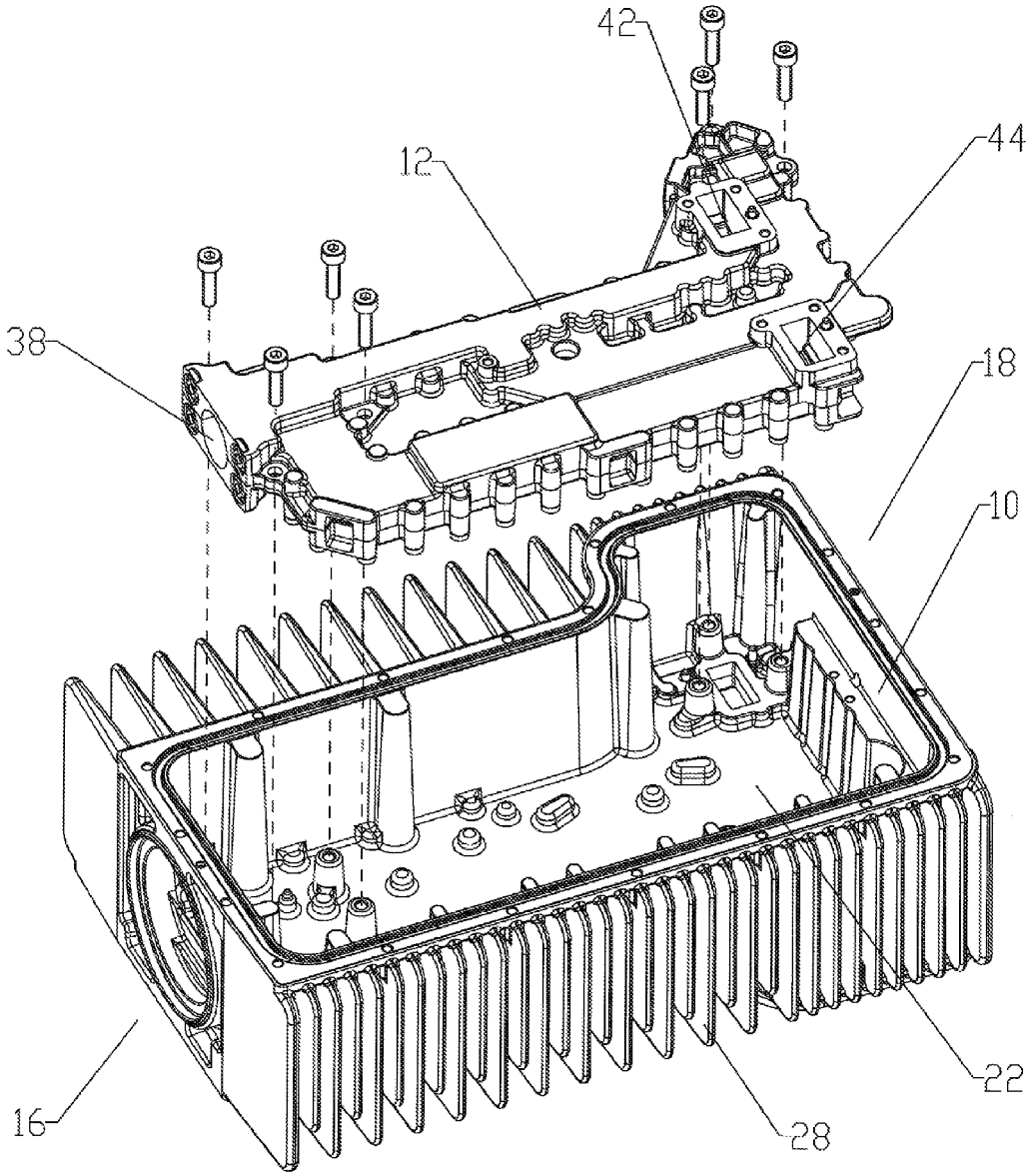
FIG. 5 is an isometric exploded view of the housing and OMT/diplexer, showing mounting surfaces for the OMT and diplexer module within the receiver cavity of the housing.

As shown in FIG. 5, the floor of the receiver cavity 22 may be adapted to receive the OMT and diplexer module 12. The OMT and diplexer module 12 is coupled to the feed flange 14 and is aligned with the enclosure 10 via a plurality of fasteners such as screws or like. The receiver printed circuit board 46 below and transmitter printed circuit board(s) 48 above are also thereby aligned to the other OMT and diplexer module 12 ports. Alternatively, a variety of snap on or interference fit connections may be applied. Also, the OMT and diplexer module 12 may be alternatively located in the transmitter cavity 20. The OMT and diplexer module 12 feed port 38 itself may form the feed flange 14 of the transceiver or alternatively the feed port 38 may be aligned directly with the feed flange 14 of the transceiver. Thereby avoiding the need for precision alignment between the OMT and diplexer module 12 to the enclosure 10 at the additional plane of the feed location.

The OMT and diplexer module 12 cross-polar reception port 40 and co-polar reception port 42 may be arranged to exit the OMT and diplexer module 12 on a common side, while the co-polar transmission port 44 exits on an opposite side to couple with the receiver printed circuit board 46 and transmitter printed circuit board(s) 48, respectively. The receiver printed circuit board 46 and the transmitter printed circuit board(s) 48 may be enclosed within the receiver cavity 22 and the transmitter cavity 20 by the receiver cavity cover 24 and the transmitter cavity cover 26 or other form of radio frequency and environmental screen. Positioning of the receiver printed circuit board 46 and the transmitter printed circuit board(s) 48 within separate reception and transmission cavities 22, 20 of the enclosure 10 isolates the electrical circuitry for transmission and reception from each other. This helps to reduce cross coupling between different circuits on the receiver and transmitter printed circuit boards 46, 48.

The planar two piece design of the OMT and diplexer module 12 enables use of cost efficient manufacturing methods such as die casting or injection molding. The X-TRF 32, C-TRF 34 and C-RRF 36 are seamlessly incorporated into the OMT and diplexer module 12, eliminating additional interconnections and potential signal degradation. The filters enable reception of signals in both orthogonal polarities while transmitting in one polarity. The OMT and diplexer module 12 may be fully tested prior to mounting in the enclosure 10; improving yield at transceiver final assembly and simplifying quality control procedures. Similarly, the enclosure 10 may be cost effectively manufactured with a high level of precision via die casting or injection molding. Cavities, ports, fastener points, alignment posts and any heat sinks may be configured for die/mold separation without interfering overhanging edges. Where injection molding is performed, a plastic material with enhanced thermal conductivity properties may be used and or the surfaces of the resulting components may be coated with a conductive material to prevent radio frequency interference or leakage. Further, to enhance heat dissipation characteristics, metal inserts may be placed within the molds before injection of the plastic material to form integral heat sinks within the molded OMT and diplexer module 12 portion(s).

One skilled in the art will appreciate that the present invention significantly improves both electrical functionality and cost efficiency. Further, the modular design enables rapid application of further mechanical and or electrical circuit improvements that may arise. Because the number of required interconnections has been reduced, a transceiver according to the invention may be smaller and lighter than previous assemblies of similar function.

TABLE OF PARTS

| | |
|---|---|
| 10 | enclosure |
| 12 | OMT and diplexer module |
| 14 | feed flange |
| 16 | front end |
| 17 | signal connection |
| 18 | back end |
| 20 | transmitter cavity |
| 22 | receiver cavity |
| 24 | receiver cavity cover |
| 26 | transmitter cavity cover |
| 28 | heat sink |
| 30 | waveguide |
| 32 | cross-polar transmit reject filter |
| 34 | co-polar transmit reject filter |
| 36 | co-polar receive reject filter |
| 38 | feed port |
| 40 | co-polar transmission port |
| 42 | co-polar reception port |
| 44 | cross-polar reception port |
| 46 | receiver printed circuit board |
| 48 | transmitter printed circuit board |

Where in the foregoing description reference has been made to ratios, integers, components or modules having known equivalents then such equivalents are herein incorporated as if individually set forth.

While the present invention has been illustrated by the description of the embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details, representative apparatus, methods, and illustrative examples shown and described. Accordingly, departures may be made from such details without departure from the spirit or scope of applicant's general inventive concept. Further, it is to be appreciated that improvements and/or modifications may be made thereto without departing from the scope or spirit of the present invention as defined by the following claims.

What is claimed is:

1. A transceiver with cross-polar, co-polar receive and co-polar transmit, comprising:

an enclosure with a receiver cavity and a transmitter cavity;

an orthomode transducer and diplexer module with a plurality of waveguides and filters between a feed port, a co-polar transmission port, a co-polar reception port and a cross-polar reception port;

the orthomode transducer and diplexer module mounted within one of the receiver cavity and the transmitter cavity;

a transmitter printed circuit board mounted in the transmitter cavity aligned with the co-polar transmission port; and a receiver printed circuit board mounted in the receiver cavity aligned with the co-polar reception port and cross-polar reception port.

2. The transceiver of claim 1, wherein the integrated orthomode transducer and diplexer module has two pieces.

3. The transceiver of claim 1, wherein the integrated orthomode transducer and diplexer module is coupled to a feed flange; the feed flange aligned with the feed port.

4. The transceiver of claim 1, wherein the integrated orthomode transducer and diplexer feed port is a feed flange for the transceiver.

5. The transceiver of claim 1, further including a receiver cavity cover covering the receiver cavity and a transmitter cavity cover covering the transmitter cavity.

6. The transceiver of claim 1, wherein the plurality of filters in the orthomode transducer and diplexer module consists of a cross-polar transmit reject filter, a co-polar transmit reject filter, and a co-polar receive reject filter.

7. The transceiver of claim 1, wherein at least one of the plurality of filters is formed in sidewalls of the waveguides.

8. The transceiver of claim 1, wherein at least one of the plurality of filters is formed by a cross section of the waveguide.

9. The transceiver of claim 1, wherein the co-polar transmission port is formed on one side of the orthomode transducer and diplexer module and the co-polar reception port and the cross-polar reception port are formed on an opposite side of the orthomode transducer and diplexer module.

10. The transceiver of claim 1, wherein the enclosure has heat sinks formed on an exterior surface.

11. The transceiver of claim 1, wherein the plurality of waveguides interconnects the feed port, the co-polar transmission port, the co-polar reception port and the cross-polar reception port.

12. The transceiver of claim 1, wherein the orthomode transducer and diplexer module is fastened to the enclosure along a single plane of connection.

13. A method of manufacturing a transceiver, comprising the steps of:

molding an enclosure with a receiver cavity and a transmitter cavity;

molding an orthomode transducer and diplexer module incorporating an orthomode transducer, a diplexer and a plurality of filters between a feed port, co-polar transmission port, co-polar reception port and cross-polar reception port;

mounting the orthomode transducer and diplexer module within the receiver or transmitter cavity;

mounting a transmitter printed circuit board in the transmitter cavity, aligned with the co-polar transmission port; and mounting a receiver printed circuit board in the receiver cavity aligned with the co-polar reception port and cross-polar reception port of the integrated orthomode transducer and diplexer module.

14. The method of claim 13, wherein the orthomode transducer and diplexer module has two diecast pieces.

15. The method of claim 13, further including the step of enclosing the transmitter cavity with a transmitter cavity cover and the receiver cavity with a receiver cavity cover.

16. The method of claim 13, wherein the molding is metal alloy die casting.

17. The method of claim 13, wherein the molding is plastic injection molding.

18. The method of claim 17, further including the step of coating the surface of the enclosure and the orthomode transducer and diplexer module with a conductive material.

19. The method of claim 17, wherein the plastic injection molding is performed using a thermally conductive plastic material.

20. The method of claim 17, wherein metal inserts are included in the plastic injection molding.

* * * * *